United States Patent [19]

Perne et al.

[11] Patent Number: 4,805,807

[45] Date of Patent: Feb. 21, 1989

[54] DISPENSING STOPPER WITH ROTATING CAP FOR PASTY PRODUCTS

[75] Inventors: Raymond Perne, Morance/Anse; Philippe Odet, Chasselay, both of France

[73] Assignee: Astra Plastique, Saint Georges De Reneins, France

[21] Appl. No.: 112,216

[22] Filed: Oct. 26, 1987

[51] Int. Cl.[4] ..... B67D 5/32

[52] U.S. Cl. ..... 222/153; 222/212; 222/521; 215/256

[58] Field of Search ..... 215/253, 256, 258; 220/266; 222/153, 206, 212, 520–521, 545–546, 541

[56] References Cited

U.S. PATENT DOCUMENTS

| | | | |
|---|---|---|---|
| 3,407,967 | 10/1968 | Stull | 222/521 X |
| 4,424,918 | 1/1984 | Stull | 222/153 |
| 4,549,667 | 10/1985 | Dullabaun | 215/252 |
| 4,570,825 | 2/1986 | Stull | 222/45 |
| 4,589,561 | 5/1986 | Crisci | 215/256 |
| 4,705,181 | 11/1987 | Burke et al. | 215/220 |

*Primary Examiner*—Michael S. Huppert

*Attorney, Agent, or Firm*—Dowell & Dowell

[57] ABSTRACT

This invention relates to a dispensing stopper with rotating cap for pasty products, wherein axial displacement of the rotating cap is effected by cooperation of two series of oblique projections in contact and by cooperation of stops and oblique ramps. The base of the cap is further provided with a tearable guarantee strip.

6 Claims, 3 Drawing Sheets

DISPENSING STOPPER WITH ROTATING CAP FOR PASTY PRODUCTS

BACKGROUND OF THE INVENTION

1. Field of the Invention

The present invention relates to a dispensing stopper with rotating cap for pasty products.

2. History of the Related Art

It is known that, for recipients or containers comprising an elastically deformable wall containing semi-liquid or pasty products, it is frequently necessary to employ stoppers arranged so as to allow the product contained in the recipient in question to be dispensed when said recipient is pressed in the user's hand.

These dispensing stoppers generally comprise a hollow body shaped so as to be firmly fastened on the opening of the deformable recipient, and a rotating cap mounted on the body in order to uncover an annular opening made axially in the body.

OBJECT OF THE INVENTION

It is to the above particular type of dispensing stopper that the invention refers, and its more especially the object to simplify the manufacture and assembly of the two constituent pieces and to ensure that the product contained in the recipient is authentic up to the moment when it is opened for the first time.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
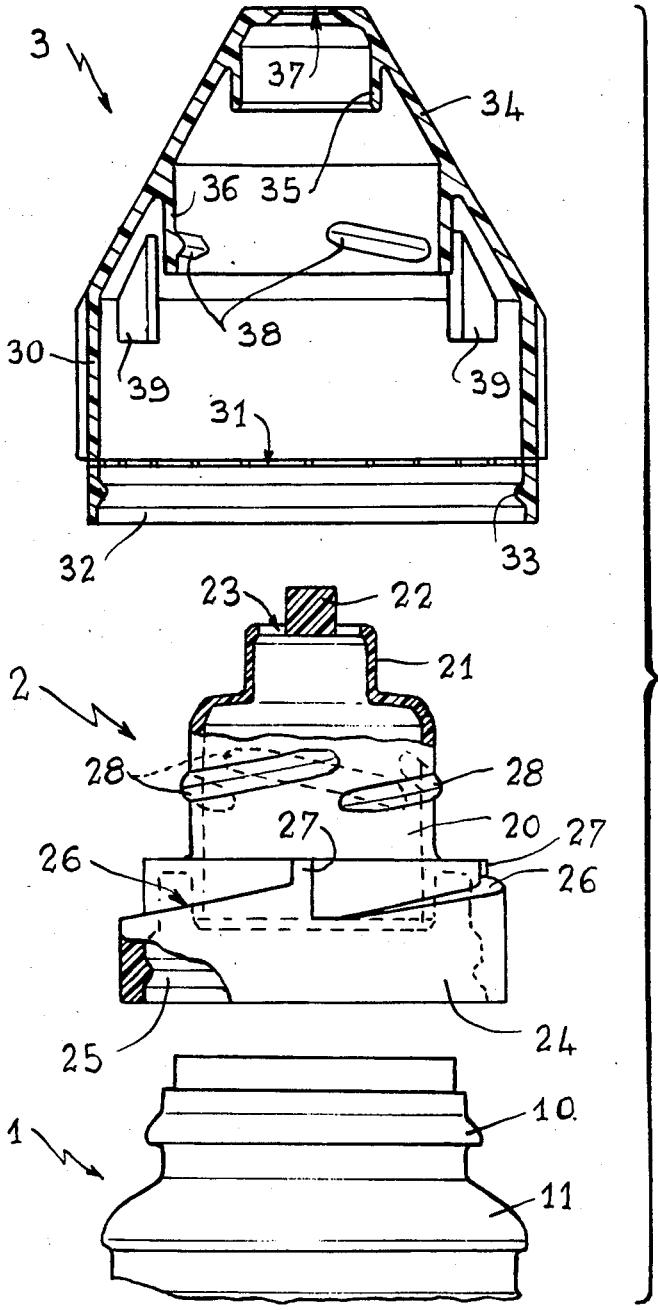
FIG. 1 is an axial section showing, in superposition, prior to assembly and mounting, the upper open part of a recipient having an elastically deformable wall, the body of a dispensing stopper according to the invention and the rotating cap associated with the body.
Figure 2:
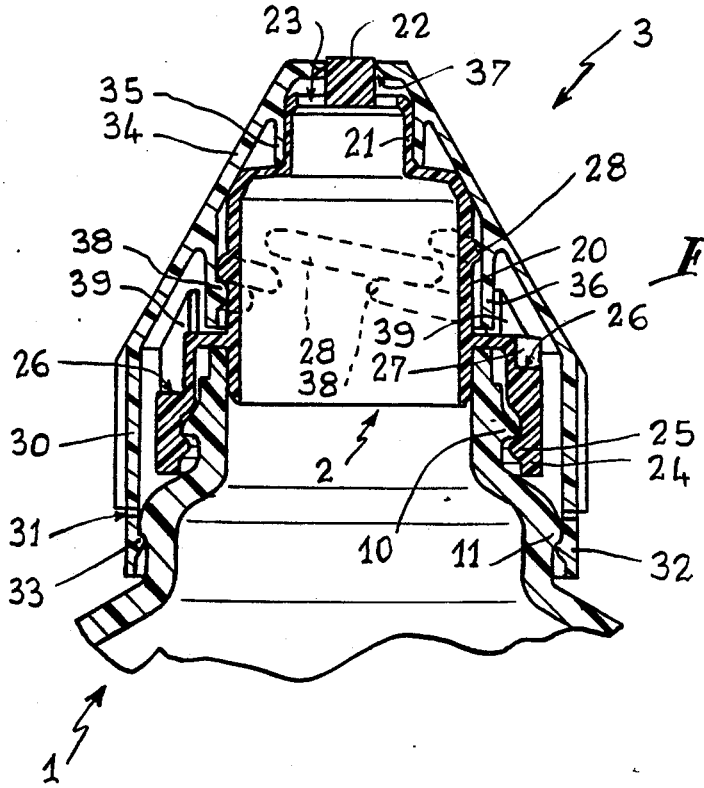
FIG. 2 shows the elements of FIG. 1 once mounted, the stopper being shown in closed position.
Figure 3:
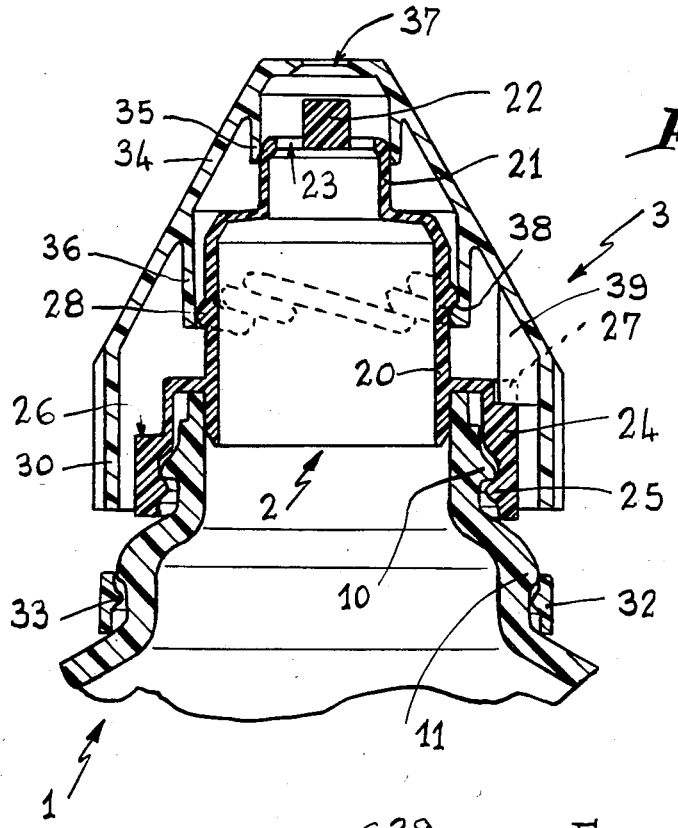
FIG. 3 reproduces FIG. 2, showing the stopper in open position.

Referring now to the drawings, in FIGS. 1 to 3, reference 1 designates the upper open part of a conventional recipient comprising an elastically deformable, or squeezable wall, the elastic deformability allowing the pasty product contained therein to be expelled under the effect of pressure exerted by the user. It will be observed that this upper part 1 presents two superposed annular beads or rings 10 and 11.

The stopper according to the invention firstly comprises a body 2 made of moulded plastics material. This body 2 is hollow and comprises a median cylindrical skirt 20 which extends upwardly to an axial endpiece 21 of smaller diameter of which the free end is rendered fast or secured with an axial boss 22, connected to the endpiece by radial arms which define an annular opening 23. Opposite the endpiece 21, the skirt 20 is connected to a base 24 of cylindrical shape, which is adapted to cover the upper part 1 of the recipient or container to which it is fastened by an inner bead 25 which engages beneath the upper ring 10 of said part 1.

The outer wall of the base 24 is sectioned to present three oblique depressions or ramps 26 which each extend over slightly less than 120° and which are separated from one another by vertically extending thresholds or walls 27. Furthermore, the outer wall of the median skirt 20 itself presents three oblique projections 28 which each extend over 120° and which are similar to three portions of threads disposed at the same height.

A rotating cap 3 is associated with body 2 and is made of plastics material and is provided at its base with a cylindrical skirt 30 of which the lower edge is connected, through an annular zone 31 of small thickness, and thus capable of being easily torn, to a guarantee strip 32 which bears on its inner face an annular bead 33 adapted to engage beneath the lower ring 11 of the recipient. The skirt 30 extends upwardly by a truncated part 34 integrally formed with two inner rings 35 and 36; the upper ring 35, disposed immediately below the top opening 37 of the cap 3, is adapted to fit around the endpiece 21 of body 2, while the lower ring 36 comprises, on its inner wall, three oblique projections 38 similar to projections 28 of the body 2.

It should be observed that the inner wall of the cap 3 further presents three vertical stops 39 oriented at 120° with respect to one another and disposed along a portion of the height of skirt 30 and a portion of the height of the truncated extension 34, as clearly shown in FIG. 1.

It will be readily understood that, by a sufficient axial effort to provoke a momentary elastic deformation of the pieces present, the projections 38 of the cap 3 are capable of coming into position below the projections 28 of the body 2, in the manner shown in FIGS. 2 and 3, consequently ensuring assembly of the cap on the body 2. Furthermore, the cooperative engagement of the projection 25 with the ring 10 and of the bead 33 with the ring 11 guarantees axial retention of the body 2 on the upper part 1 of the recipient.

Figure 5:
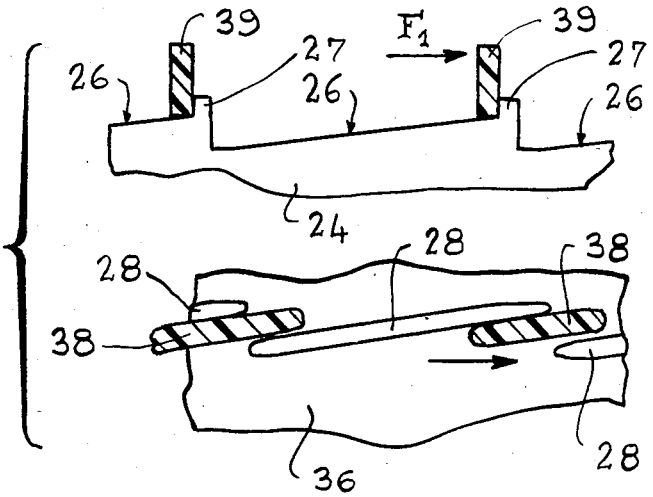

In FIG. 2, the cap 3 is shown in a lowered position for which the axial boss 22 is engaged in the opening 37, thus rendering any expulsion of the product impossible. If, from this low position, the user rotates the cap 3 in the direction indicated by arrow F1 in FIG. 5, the stops 39 will abut against the ramps 26, consequently causing the cap to lift with respect to the body 2, and this movement will continue until the stops 39 abut against the thresholds 27 which limit the degree of rotation. The lifting of the cap 3 obviously provokes a tearing of the thin zone 31, with the result that the guarantee strip 32 is detached from the skirt 30, while remaining fastened by its bead 33 below the ring 11. At the same time, the opening 37 moves away from boss 22, so that, by pressure exerted by the user on the deformable wall of the recipient, the pasty contents thereof can escape to the outside through opening 23 and opening 37. The position is then the open one illustrated in FIG. 3.

Figure 4:
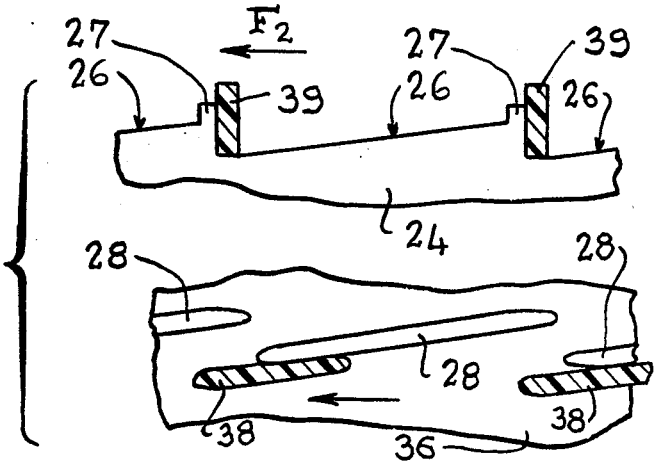
FIGS. 4 and 5 are developed sections illustrating operation of the present invention.

To close the recipient, it suffices to rotate the cap in the direction indicated by arrow F2 in FIG. 4, until the stops 39 abut against the opposite vertical face of the thresholds 27. In this movement, the oblique projections 38 bear against the projections 28 which guide them downwardly, forcing the cap to move axially to the closed position of FIG. 2 for which the axial boss 22 obturates the opening 37.

It is very practical to open and close the stopper. Manufacture of the two pieces 2 and 3 of this stopper is simplified since these pieces comprise only a very small number of undercut parts, while assembly thereof is effected by simple axial pressure.

It must, moreover, be understood that the foregoing description has been given only by way of example and that it in no way limits the domain of the invention which would not be exceeded by replacing the details of execution described by any other equivalents.

What is claimed is:

1. A dispenser for pasty products comprising a container having elastically deformable walls, said container having an opening disposed along an elongated axis, a body member including an annular base having inner and outer portions, a central cylindrical skirt of a lesser diameter than said annular base and an end piece which is of a lesser diameter than said central cylindrical skirt, said end piece being coupled to a central boss extending along said axis of said container, an opening between said boss and said end piece and arm means for supporting said boss with respect to said end piece, first oblique projection means extending outwardly of said central cylindrical skirt, inclined ramp means disposed along said outer portion of said annular base, first stop means associated with said ramp means, a cap means having inner and outer portions, said cap means having first and second annular skirt means depending from said inner portion thereof, said first skirt means surrounding said end piece of said body member, said second skirt means including second oblique projections for slidingly engaging said first oblique projections below said first skirt means, and second stop means disposed along said inner portion of said cap means below said second skirt means for selectively engaging said first stop means.

2. The dispensing apparatus of claim 1 in which said container includes a ring member disposed adjacent said opening, said annular base of said body member including an annular projection disposed along said inner portion thereof, said annular projection being selectively engageable with said ring member so as to retain said body member in engagement with said container.

3. The dispensing apparatus of claim 2 in which said second stop means carried by said cap means is selectively engageable with said inclined ramp means disposed along said outer portion of said annular base, said first stop means being disposed along the uppermost portion of said inclined ramp means.

4. The dispensing apparatus of claim 1 in which said inclined ramp means includes three inclined ramps, each of which extends less than 120° with respect to said annular base.

5. The dispensing apparatus of claim 4 in which said first oblique projections include three separate projection members, each of which extends over 120° with respect to said central cylindrical skirt.

6. The dispensing apparatus of claim 5 in which said first stop means includes three first elements which are spaced in approximately 120° relationship with respect to one another and second stop means includes three second elements which are spaced in approximately 120° relationship with respect to one another.

* * * * *